United States Patent [19]

Lundin et al.

[11] Patent Number: 4,566,638

[45] Date of Patent: Jan. 28, 1986

[54] CONE CRUSHER

[75] Inventors: Sven-Ake Lundin, Malmö; Arvid Svensson, Vintrie, both of Sweden

[73] Assignee: Svedala-Arbra AB, Svedala, Sweden

[21] Appl. No.: 543,265

[22] Filed: Oct. 19, 1983

[30] Foreign Application Priority Data

Oct. 22, 1982 [SE] Sweden ..... 8206003

[51] Int. Cl.[4] ..... B02C 2/06

[52] U.S. Cl. ....., 241/37; 241/210; 241/215

[58] Field of Search ..... 241/207–216, 241/33, 37; 74/87

[56] References Cited

U.S. PATENT DOCUMENTS 1,936,728 11/1933 McCaskell .
4,272,030 6/1981 Afanasiev et al. ..... 241/210 X
4,463,908 8/1984 Ivanov et al. .

FOREIGN PATENT DOCUMENTS 2307022 8/1974 Fed. Rep. of Germany .
2307023 8/1974 Fed. Rep. of Germany .
421865 2/1982 Sweden .
421866 2/1982 Sweden .
886968 12/1981 U.S.S.R. ..... 241/210

*Primary Examiner*—Mark Rosenbaum
*Attorney, Agent, or Firm*—Merchant, Gould, Smith, Edell, Welter & Schmidt

[57] ABSTRACT

The object of the invention is a cone crusher comprising a shaft mounted in a frame for oscillating movement, and a rotor which is rotatably mounted on the shaft and adapted to be rotated on the shaft by means of a drive and which has an out-of-balance weight so that the rotation of the rotor in conjunction with centrifugal force sets the shaft in gyratory oscillating motion, while a conical crusher head carried by the shaft is caused to roll on the inner side of a crushing mantle carried by the frame. Characteristic of the invention is that the cone crusher is equipped with a movable counterweight which is caused by the drive to perform a circular movement about the shaft at an angular displacement of substantially 180° relative to the movement of the eccentrically located point of gravity of the rotor, whereby the counterweight substantially contributes to stabilizing the frame in that the centrifugal force acting upon the frame actuates the frame substantially in phase opposition to radial forces which are transmitted to the frame from the rotor and the out-of-balance weight thereof via the shaft, the bearing points of the shaft and the crusher head.

9 Claims, 5 Drawing Figures

25
1
25
13

CONE CRUSHER

This invention relates to a cone crusher comprising a shaft mounted for gyratory oscillating movement in a frame, a rotor rotatably mounted on the shaft, and a drive adapted to rotate the rotor on said shaft, said rotor having an out-of-balance weight so that the rotation of the rotor in conjunction with centrifugal force sets the shaft in gyratory oscillating motion, whereby a conical crushing head carried by the shaft is caused to roll on the inner side of an annular conical crushing mantle carried by the frame.

In cone crushers operating by inertia the crushing head is caused to roll with its crushing mantle around the inner side of the outer crushing mantle carried by the frame in that the vertical crusher shaft mounted in the frame as a gyratory pendulum is caused, without actually rotating, to effect a gyratory oscillating movement because an out-of-balance mass rotatably mounted on a portion of the crusher shaft (rotor with eccentric weight distribution) is brought to rotate and by the effect of centrifugal force subjects the shaft to a radial force.

The object of the invention is to stabilize the frame against this force, and to this end the cone crusher according to the invention has been given the characteristic features.

The invention will now be described in greater detail with reference to the accompanying drawings in which.

Figure 3:
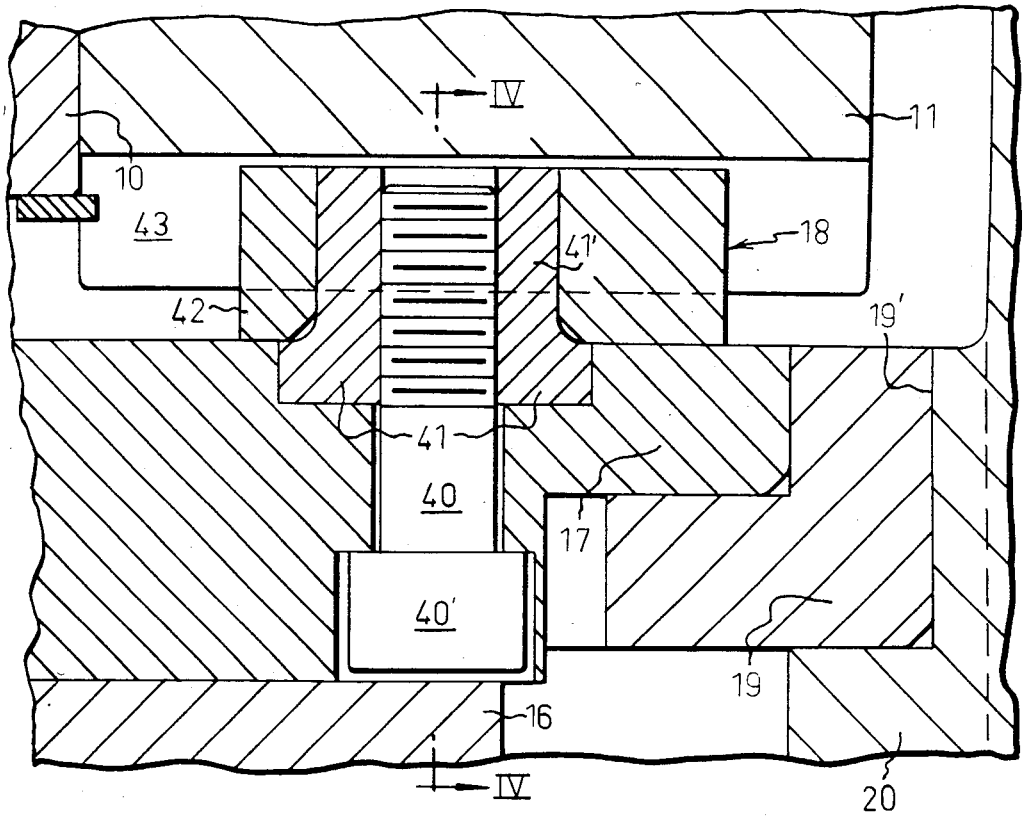
Figure 4:
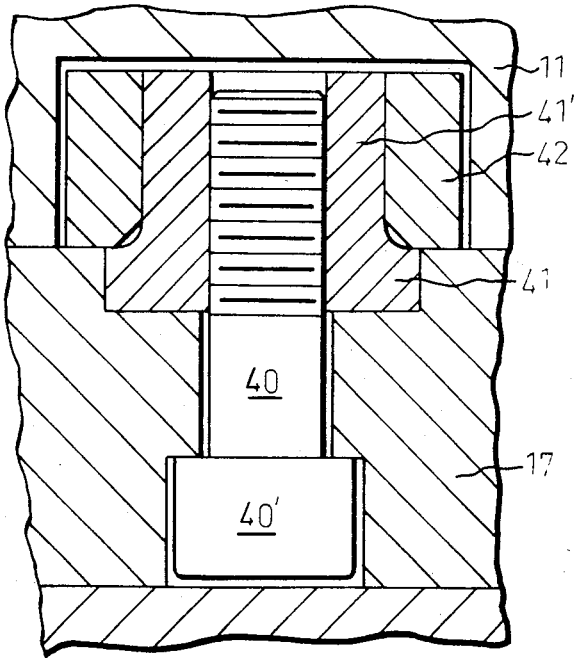

FIG. 3 in vertical section and on a larger scale shows the driver for rotating the rotor;

FIG. 4 is a section on the line IV—IV in FIG. 3; and

Figure 5:
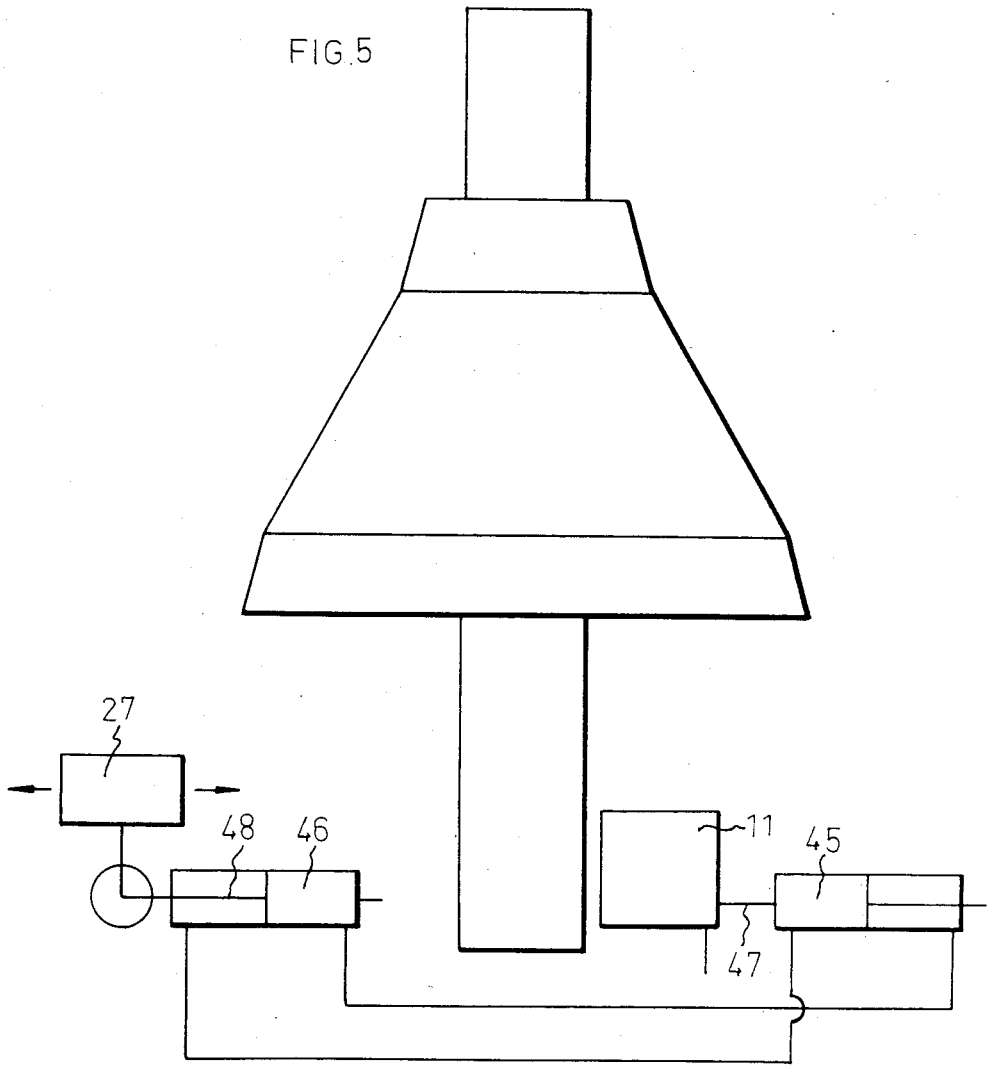

FIG. 5 is a diagrammatic view of a counterweight adjusting device.

The frame of the cone crusher, the main portion of which is generally designated 1, rests on a base via a suitable number of resilient supports 2 and carries with the aid of an upper, dismountable frame portion 1' an outer, annular crushing mantle 3 and a top bearing housing 4 for mounting the top end of the crusher shaft 5 which is arranged for gyratory oscillating movement in the frame and which conventionally comprises a crusher head 6 with an inner crushing mantle 7, said crusher shaft being supported at the lower end via a spherical bearing generally designated 8 on a hydraulic piston 9 by means of which the crusher shaft 5 can be raised and lowered for adjustment of the crushing gap width between the two crushing mantles.

An annular rotor 10 rotatably mounted on a portion of the crusher shaft 5 between the crusher head 6 and the lower end of the crusher shaft, which portion is formed as a cylindrical shaft 5'. The annular rotor 10 has an eccentrically located mass, i.e. the rotor has its point of gravity offset radially outwardly from the axis of the crusher shaft, which constitutes the axis of rotation of the rotor. In the embodiment illustrated this has been realized in that the rotor on one side has an enlarged part 10' with a weight 11, for instance of lead, disposed in a pocket in said enlarged part.

The rotor 10 is rotatable about the shaft 5' by means of a drive, generally designated 12, comprising a drive shaft 13 which by means of bearings 14 is mounted in a frame and at the lower end carries a bevel gear 15 engaging a bevel gear rim 16 which is connected to the rotor, for instance in that the gear rim is connected to an annular plate 17 which is connected by a driver 18 to the rotor and is rotatably mounted on a supporting bearing ring 19 which in turn is supported by studs 20 on the frame. At the upper end the rotor is mounted relative to the frame by means of a bearing ring 21 and relative to the shaft 5' by means of a spherical rolling bearing and an axial slide bearing 22 and 23, respectively.

During rotation of the out-of-balance rotor, the out-of-balance owing to centrifugal force actuates the crusher shaft with a rotating force component which is exerted at right angles from the axis of said shaft, whereby the crusher head 6 with the inner crushing mantle 7 is caused to roll on the outer crushing mantle 3 at a rolling speed corresponding to the speed of the out-of-balance rotor.

To permit being carried on the resilient supports 2 the frame 1 is provided, in the embodiment shown by way of example, with a number of feet, for instance four feet 25 distributed about the periphery and arranged as box-shaped pockets in which inertia-increasing ballast is contained.

However, it is possible to make the frame more lightweight or, in other words, it is possible to use a frame of less mass (ballast), thereby reducing the crusher weight on the base at the frame support points at 2, by disposing a preferably or say crescent-shaped counterweight 27—as illustrated—in an annular housing 26 which surrounds the rotor and is connected to or constitutes part of the frame 1. This counterweight is adapted to be driven around in the frame housing 26 by the annular plate 17. As will appear from the following, the centrifugal force acting upon the counterweight 27 is not, however, transmitted to the rotor proper but instead to the housing in a substantially diametrical position relative to the out-of-balance weight 11 of the rotor. The mass of the counterweight 27 which is adapted to the out-of-balance mass of the rotor 10, will thus, at least mainly, act in phase opposition upon the frame relative to the effect of the out-of-balance rotor on said frame via friction and pressure surfaces, such as the effect of the inner crushing mantle on the outer crushing mantle via the material crushed and via the bearings and the hydraulic piston 9.

Figure 1:
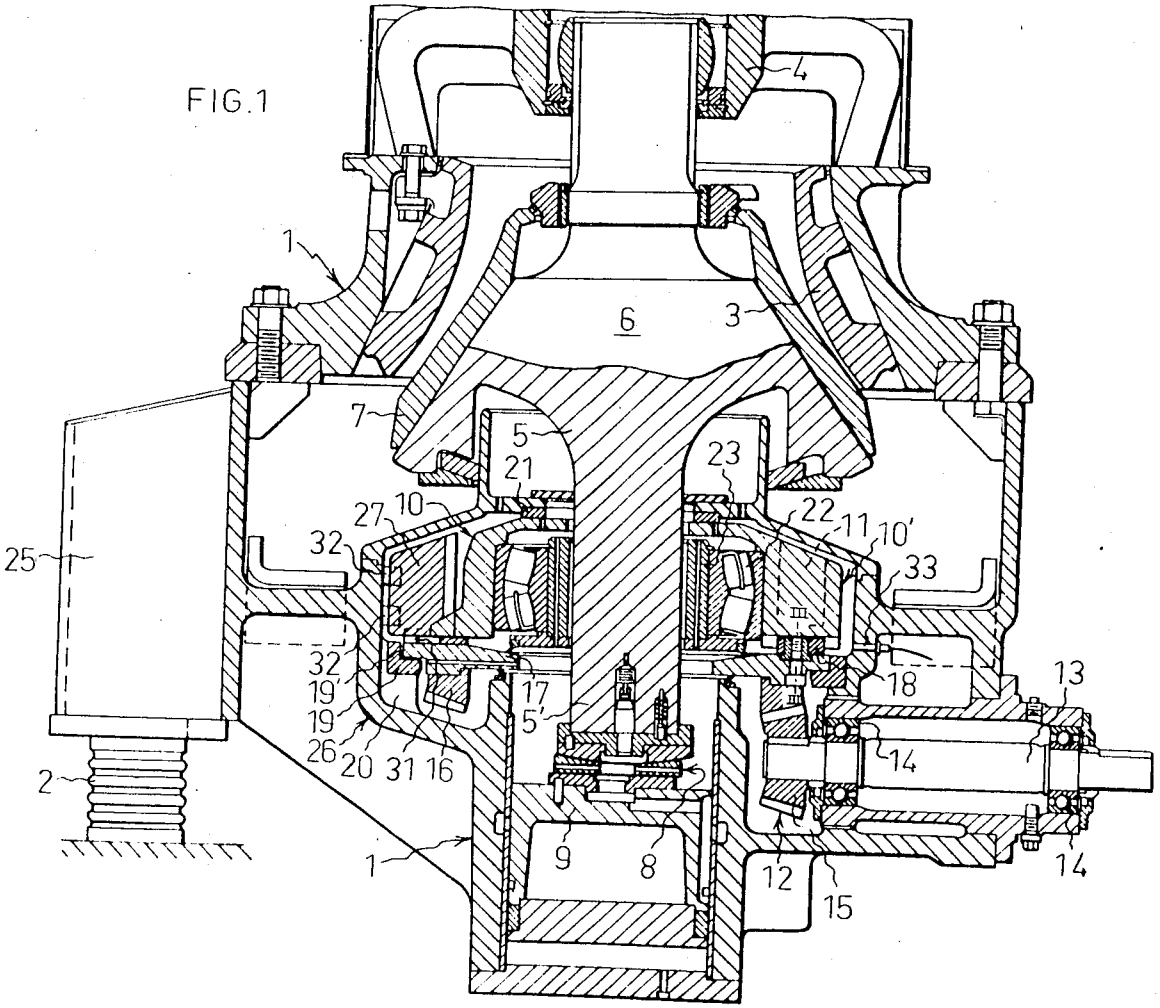
FIG. 1 is an axial section of a cone crusher according to the invention.
Figure 2:
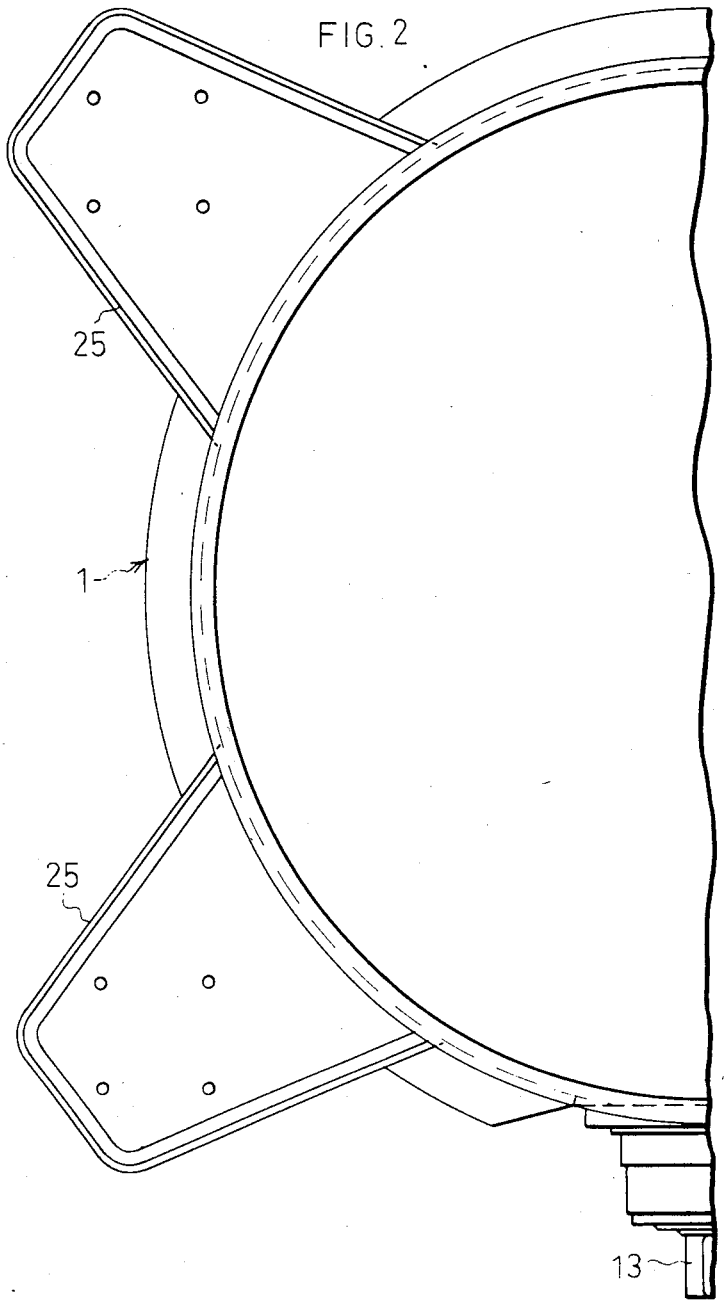
FIG. 2 is a cross-section taken on the line II—II in FIG. 1.

To transmit the radial force component from the counterweight 27 to the frame, said counterweight is, for instance as illustrated, radially movable on the annular plate 17 and rotatably associated with said plate with the aid of say guide grooves and guide surfaces 31 with which the counterweight 27 and the plate 17, respectively, are provided. For reduction of the friction against the inner side of the annular frame housing 26, the counterweight 27 may be provided, as shown in FIG. 1, with a number of friction reducing rollers 32. It should, however, be observed that the counterweight arrangement described above and illustrated in the drawing is only to be considered as an illustrative, but nevertheless practical and simple embodiment since several modifications are conceivable for driving a counterweight in synchronism with the out-of-balance rotor and at a phase shift of almost 180° relative to the out-of-balance mass 11 or of the eccentrically located point of gravity of the rotor so that the out-of-balance forces on the system rotor-crusher shaft-crusher head, on the one hand, and the frame, on the other hand, always act substantially in phase opposition to each other for reduction or elimination of the tendency of the out-of-balance mass to shake the frame during operation. It is conceivable to use for instance a counterweight which is fixedly connected with the plate 17 and in relation to which the rotor, as is also the case in the embodiment illustrated, is mounted "floating" in that the driver 18 permits a radial movement between the plate 17 and the rotor. In a modified embodiment in which the counterweight is anchored to the plate 17, the force from the counterweight can be absorbed by radial bearing surfaces 19' which are connected to the studs 20.

Another advantage gained by the counterweight arrangement according to the invention is that for the same driving power on the shaft 5' the counterweight increases the crushing effect of the crusher head and/or reduces the driving power and energy demand for a given crushing effect and/or for a certain frame mass in that the frame behaves more rigidly relative to the crusher head.

Further, it should be observed in this context that it is possible, by suitable choice of the heaviness and/or appropriate setting of the counterweight radially and/or with regard to the angle of the moment arm of the counterweight (by setting the counterweight laterally, i.e. in circumferential direction at an angle relative to a radius), to realize a rotary phase-shifted counterforce for balancing the frame and thus also for balancing the outer crushing mantle against the rotary force to which the frame and the outer crushing mantle are exposed by the out-of-balance of the rotor. A further possibility of adjustment is a height adjustment of the counterweight. By suitable dimensioning and/or setting of the counterweight and its radius of rotation with regard to the out-of-balance weight of the rotor and the radius thereof the outer crushing mantle can therefore be supported by a rotary counterforce against the rotary pressure force of the crusher head against the inner crushing mantle during operation.

FIG. 5 diagrammatically shows an embodiment in which the centrifugal force on the rotor in the region of the out-of-balance weight 11 operates a servo-motor, i.e. the piston of a hydraulic cylinder, which in turn controls a sequence servo-motor, for example by actuating the piston of another hydraulic cylinder by displacement of hydraulic oil in the manner illustrated in FIG. 5. The other servo-motor automatically controls the setting of the counterweight 27 in dependence on the centrifugal force acting upon the out-of-balance weight 11. Of course, the two servo-motors can be replaced by other devices, for example electronic power sensors which sense the centrifugal force acting upon the out-of-balance weight and via a motor control the setting of the counterweight. For this, use can be made of electronic control technics for finely tuned setting and thus finely tuned balancing of the frame, without any control power being taken from the drive motor of the crusher.

The driver 18 briefly mentioned above constitutes an important part of the device according to the invention for rotating the rotor and the counterweight 27. In the following, a preferred embodiment is therefore described in detail with reference to FIGS. 3 and 4.

FIG. 3 shows at 40 a threaded driving pin which has its pin head 40' tensioned with the aid of a nut 41 against an abutment between a hole for the pin and a recess for the pin head in the annular plate 17. The nut 41 has an upper portion 41' with cylindrical circumference and a driving block 42 is rotatably mounted on this portion, said block being movably guided in a guide groove 43 formed in the out-of-balance weight 11 (or in the rotor) and having a substantially radial longitudinal axis.

In operation, the driving pin 40, the nut 41 and the block 42 are moved in a rotary orbit, while the block 42 effects a guided sliding movement back and forth in the groove 43. In the embodiment illustrated, the block 42 is of parallelpipedical shape and has the purpose of increasing the bearing and power transmission surfaces between driving pins 40 or the nut 41 and the rotor. The block rests with a flat lower bearing surface on a flat upper bearing surface of the annular plate 17, and in operation these bearing surfaces can be lubricated with the aid of a common lubricating system, like the guide surfaces and other bearing surfaces.

Because of the complicated power play in the crusher according to the invention it is desirable to be able to follow and, when need be, control the angle of deflection of the crusher shaft. In the embodiment illustrated of the crusher, use is made for this purpose of a detector/transducer 33 which senses the varying distance between the circumference of the out-of-balance rotor 10 and the inner side of the frame housing 26, said detector/transducer being connected to a suitable instrument which shows the angle of deflection of the crusher shaft 5. The detector/transducer can also be electrically connected to a device which automatically controls the speed of the out-of-balance rotor 10 by control of the drive machinery, and may optionally be connected to a servo-motor by means of which the position of the entire counterweight 27 or of a small portion thereof can be adapted to the out-of-balance weight 11 of the rotor.

An example of an automatically operating setting device for the counterweight 27 is diagrammatically shown in FIG. 5. This device which has already been described in general terms in the foregoing comprises two hydraulic motors 45, 46 which rotate together with the rotor. One hydraulic motor 45 senses the angular deflection of the crusher shaft, for instance by the piston rod 47 of the hydraulic motor being connected to the rotor 10 in the range of the out-of-balance weight 11, and displaces hydraulic liquid to and from the other hydraulic motor the piston of which is caused to follow the movements of the piston in the hydraulic motor 45 and which via its piston rod 48 moves the counterweight 27 outwardly or inwardly. As a result, the angle of deflection of the crusher shaft can automatically be kept substantially constant. If desired, this device can be combined with the detector/transducer 33 for automatic control of both angle of deflection and speed. Instead of the hydraulic motor 45, 46 use can of course be made of say electric motors and electronic control so that one motor 46 is controlled by the other motor 45.

Irrespective of its position on the annular plate 17, the counterweight 27 shall act upon the frame. This may be achieved most readily by having the counterweight act upon the bearing surface 19' via the support member (support plate) 17.

What we claim and desire to secure by Letters Patent is:

1. A cone crusher comprising a shaft mounted in a frame for gyratory oscillating movement, a rotor rotatably mounted on the shaft, and a drive adapted to rotate the rotor on said shaft, said rotor having an out-of-balance weight so that the rotation of the rotor in conjunction with centrifugal force sets the shaft in a gyratory oscillating motion, whereby a conical crushing head carried by the shaft is caused to roll on the inner side of an annular conical crushing mantle carried by the frame, characterised by a movable counterweight which is adapted to be driven by the drive in a circular movement about and radially spaced from said shaft and which is maintained in a position always angularly displaced substantially 180° relative to the movement of the eccentrically located point of gravity of the rotor, said counterweight being carried radially displaceably relative to the shaft on a support member movable in an orbit about the shaft by means of the drive.

2. A cone crusher as claimed in claim 1, characterised by the fact that the frame carries an annular wall and that the counterweight is arranged to be moved in its orbit supported by said wall or said bearing surface.

3. A cone crusher as claimed in claim 1, characterised by the fact that the counterweight 27 and its support member 17 have cooperating guiding devices 31; 41 which permit substantially radial movement of the counterweight on the support member and constitute driver means between the rotor and the counterweight.

4. A cone crusher as claimed in claim 1, characterised by the fact that the drive 12 is adapted to drive the rotor 10 via said support member 17 by means of driver means 18 which in turn are adapted during operation of the rotor to permit radial movement between the rotor and said support member 17.

5. A cone crusher as claimed in claim 4, characterised by the fact that the driver means 18 comprise a block connected to said support member 17 or said rotor 10 and forming a power transmission and sliding bearing means, said block being movably guided in a guide groove with its radial main axis direction in the rotor.

6. A cone crusher as claimed in claim 1, characterised by the fact that the drive 12 for rotor 10 and for the counterweight 27 includes a shaft 13 with a bevel gear 15 in mesh with a bevel gear rim (16) which is mounted in relation to said shaft (13) and which directly or via said support member (17) carries the counterweight (27) and the out-of-balance rotor (10).

7. A cone crusher as claimed in claim 1, characterised by the fact that the counterweight is supported on the annular wall via friction reducing rollers 32.

8. A cone crusher as claimed in claim 1, characterised by a device for sensing the angular deflection of the crusher shaft 5 in operation, and a device for automatic setting of the position of the counterweight with regard to said angular deflection.

9. A cone crusher comprising a shaft 5 mounted in a frame (1) for gyratory oscillating movement, a rotor 10 rotatably mounted on the shaft 5, and a drive 12 adapted to rotate the rotor on said shaft, said rotor having an out-of-balance weight 11 so that the rotation of the rotor in conjunction with centrifugal force sets the shaft in a gyratory oscillating motion, whereby a conical crushing head 6, 7 carried by the shaft is caused to roll on the inner side of an annular conical crushing mantle 3 carried by the frame, characterised by a movable counterweight 27 which is adapted to be driven by the drive 12 in a circular movement about and radially spaced from said shaft 5 at an angular displacement always of substantially 180° relative to the movement of the eccentrically located point of gravity of the rotor, and by the fact that the counterweight 27 acts through pressure against the frame 1, to transmit to said frame an essential part of the centrifugal force acting upon the counterweight during the circular movement so that that part of the radial force of the rotor exerted on the shaft 5 during the rotation of the rotor, which is transmitted to the frame 1 via the bearings of the shaft 5 and by the rolling of the crusher head on the annular crusher mantle 3, is constantly counteracted by an oppositely directed force from the counterweight 27 for balancing and stabilizing the frame.

* * * * *